United States Patent [19]

Norton

[11] 4,284,095

[45] Aug. 18, 1981

[54] TOP-ERECTED UMBRELLA WITH CANTILEVERED SUPPORT

[75] Inventor: Don S. Norton, Clinton, Miss.

[73] Assignee: Don Norton Manufacturing Co., Inc., Clinton, Miss.

[21] Appl. No.: 113,122

[22] Filed: Jan. 17, 1980

[51] Int. Cl.[3] ..... A45B 11/00; A45B 23/00

[52] U.S. Cl. ..... 135/21; 135/8

[58] Field of Search ..... 135/21, 5.1, 6, 7, 8, 135/16

[56] References Cited

U.S. PATENT DOCUMENTS

| | | | |
|---|---|---|---|
| 176,146 | 4/1876 | McRedmond et al. | 135/21 |
| 200,945 | 3/1878 | Smith | 135/21 |
| 302,187 | 7/1884 | Brock | 135/21 |
| 344,094 | 6/1886 | Fosburgh . | |
| 350,262 | 10/1886 | McAuliffe | 135/21 |
| 373,809 | 11/1887 | Blunt | 135/5.1 |
| 508,418 | 11/1893 | Heaney | 135/21 |
| 524,535 | 8/1894 | Steinbach | 135/21 |
| 2,767,723 | 10/1956 | Sears | 135/21 |
| 2,984,249 | 5/1961 | Sears et al. | 135/21 |
| 3,383,814 | 5/1968 | Rowe | 135/21 |

*Primary Examiner*—J. Karl Bell

*Attorney, Agent, or Firm*—Cushman, Darby & Cushman

[57] ABSTRACT

The flexible cord used to erect the umbrella from the top, passes through a cantilever tube, the inner end of which is removably supported in a bracket. A notch in the bracket tensions the canopy and locks the umbrella to the bracket by catching a bead fixed on the cord. Three ways of supporting the bracket are shown, as is a way of storing the device.

14 Claims, 9 Drawing Figures

Fig. 5
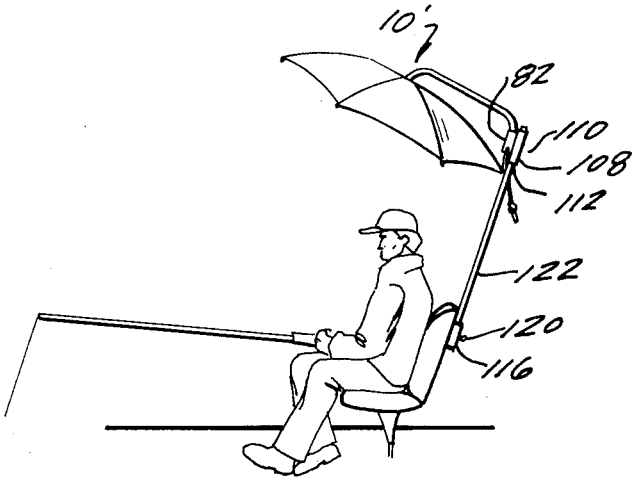
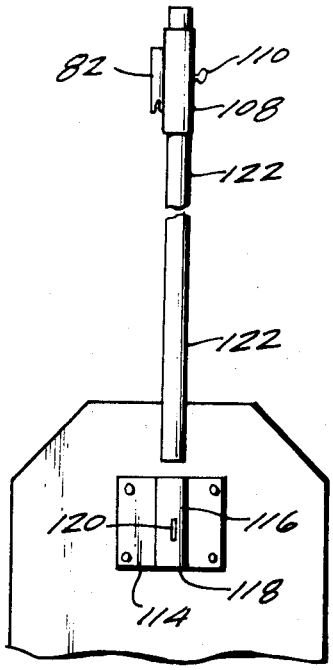
Fig. 6
Fig. 7
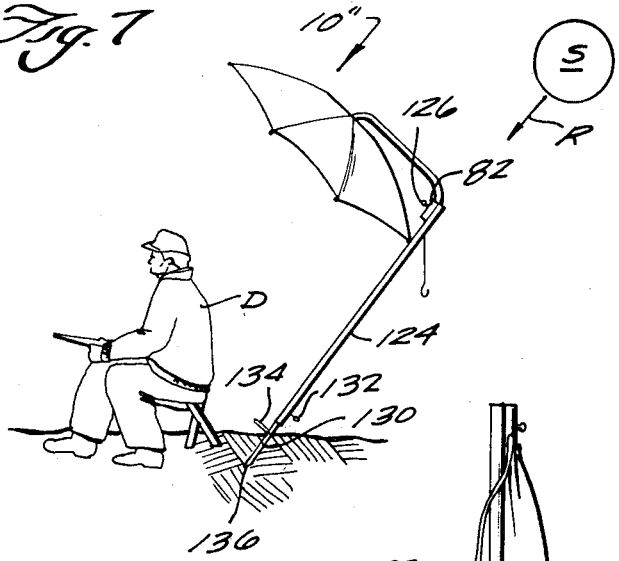
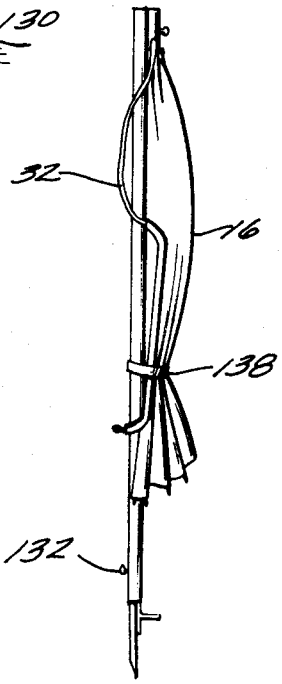
Fig. 8
Fig. 9
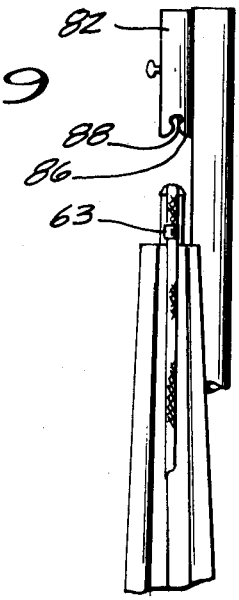

TOP-ERECTED UMBRELLA WITH CANTILEVERED SUPPORT

BACKGROUND OF THE INVENTION

The umbrellas in most apparent widespread use are erected from the bottom and are supported on a standard which depends longitudinally centrally from the apex of the canopy. In a way, their basic design is as old as the toad stool.

Umbrellas of other basic designs hark back to flowers, which are stalk-supported from outside the canopy or palm fronds, where the canopy is supported at its rim, cantilever fashion, by the stem. Usually in the prior art umbrellas of the top opening, cantilevered support type are shown for use as parasols for children's carriages, farm tractors, bicycles or as mosquito netting supports for beds.

SUMMARY OF THE INVENTION

The flexible cord used to erect the umbrella from the top, passes through a cantilever tube, the inner end of which is removably supported in a bracket. A notch in the bracket tensions the canopy and locks the umbrella to the bracket by catching a bead fixed on the cord. Three ways of supporting the bracket are shown, as is a way of storing the device.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS

In the drawings:

FIG. 5 is a side elevational view of a second embodiment of the device in typical use by a fisher; and FIG. 6 is an exploded rear elevational view on a larger scale, of part of the device of FIG. 5, centered on the back of the fisher's chair.

FIG. 7 is a side elevational view of a third embodiment of the device in typical use by another hunter.

FIG. 8 is an elevational view of the device of FIG. 7 with the umbrella canopy collapsed and the parts associated in another manner for storage; and FIG. 9 is an exploded elevational view of part of what is depicted in FIG. 8, centered on the apex of the umbrella canopy.

DETAILED DESCRIPTION

Figure 3:
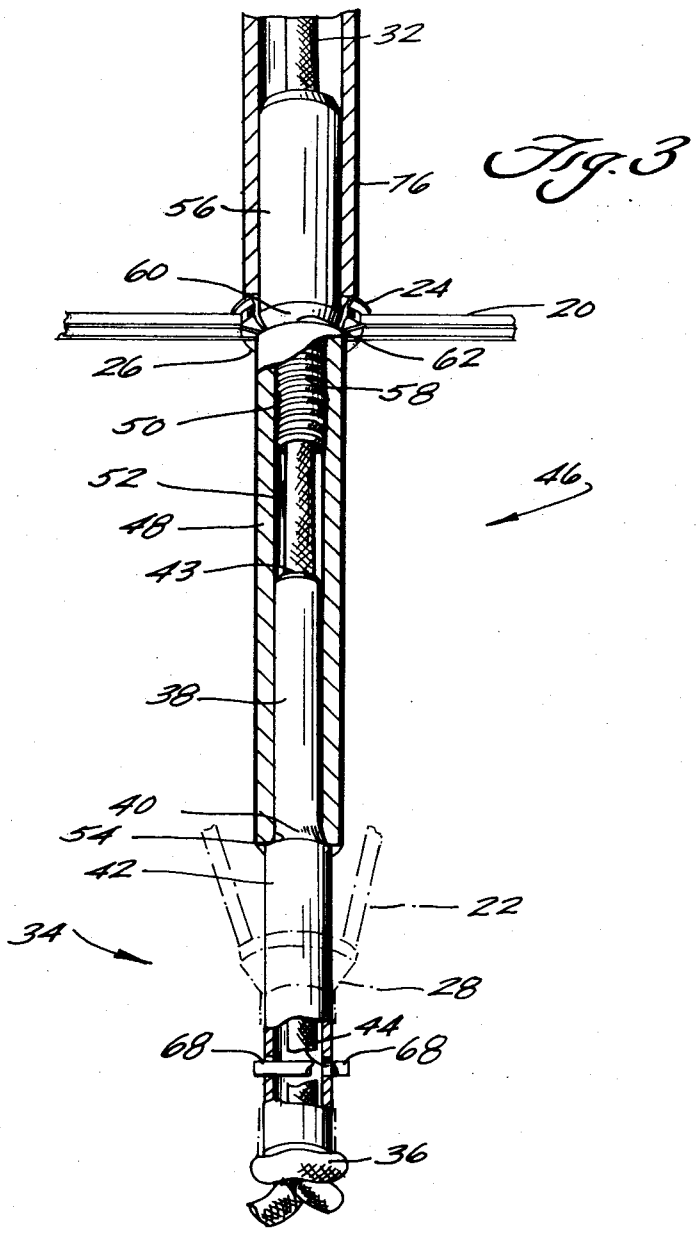
FIG. 3 is a larger scale fragmentary longitudinal perspective view of part of the device, centered on the apex of the umbrella canopy.
Figure 1:
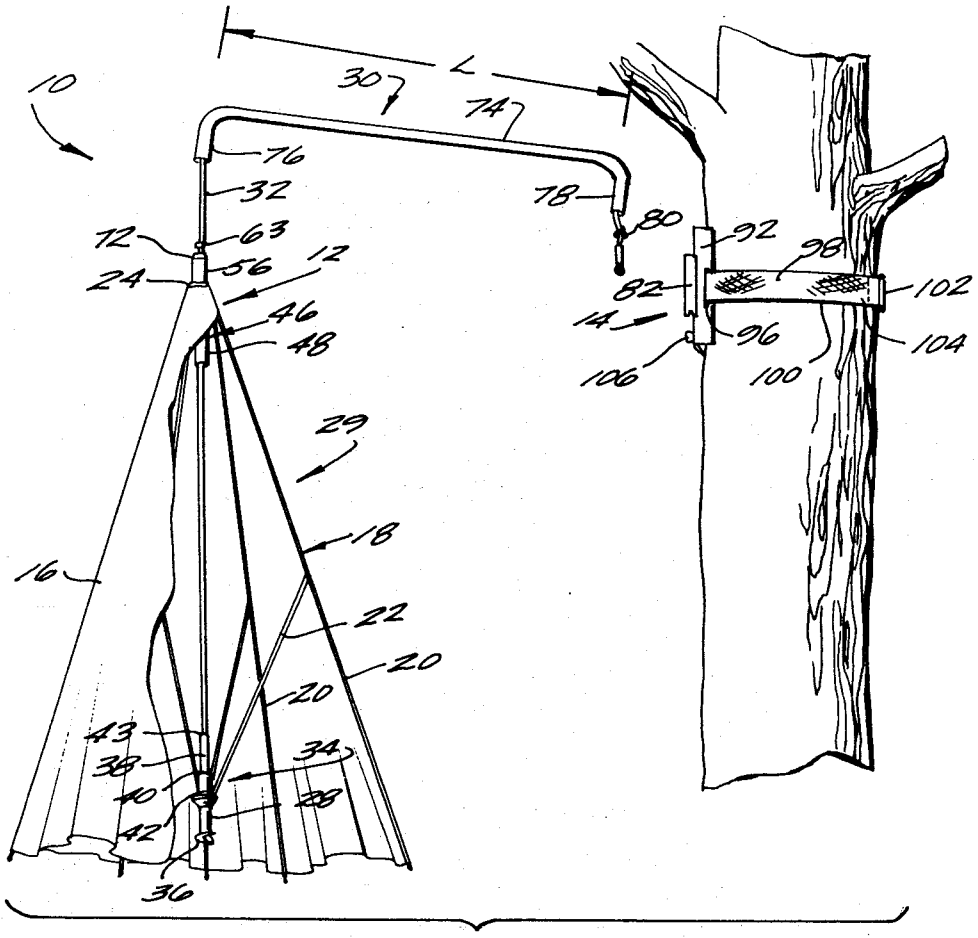
FIG. 1 is a perspective view of a first embodiment of the umbrella of the present invention, shown with the two major sub-assemblies separated and with the umbrella canopy collapsed and cut away to show interior details.
Figure 4:
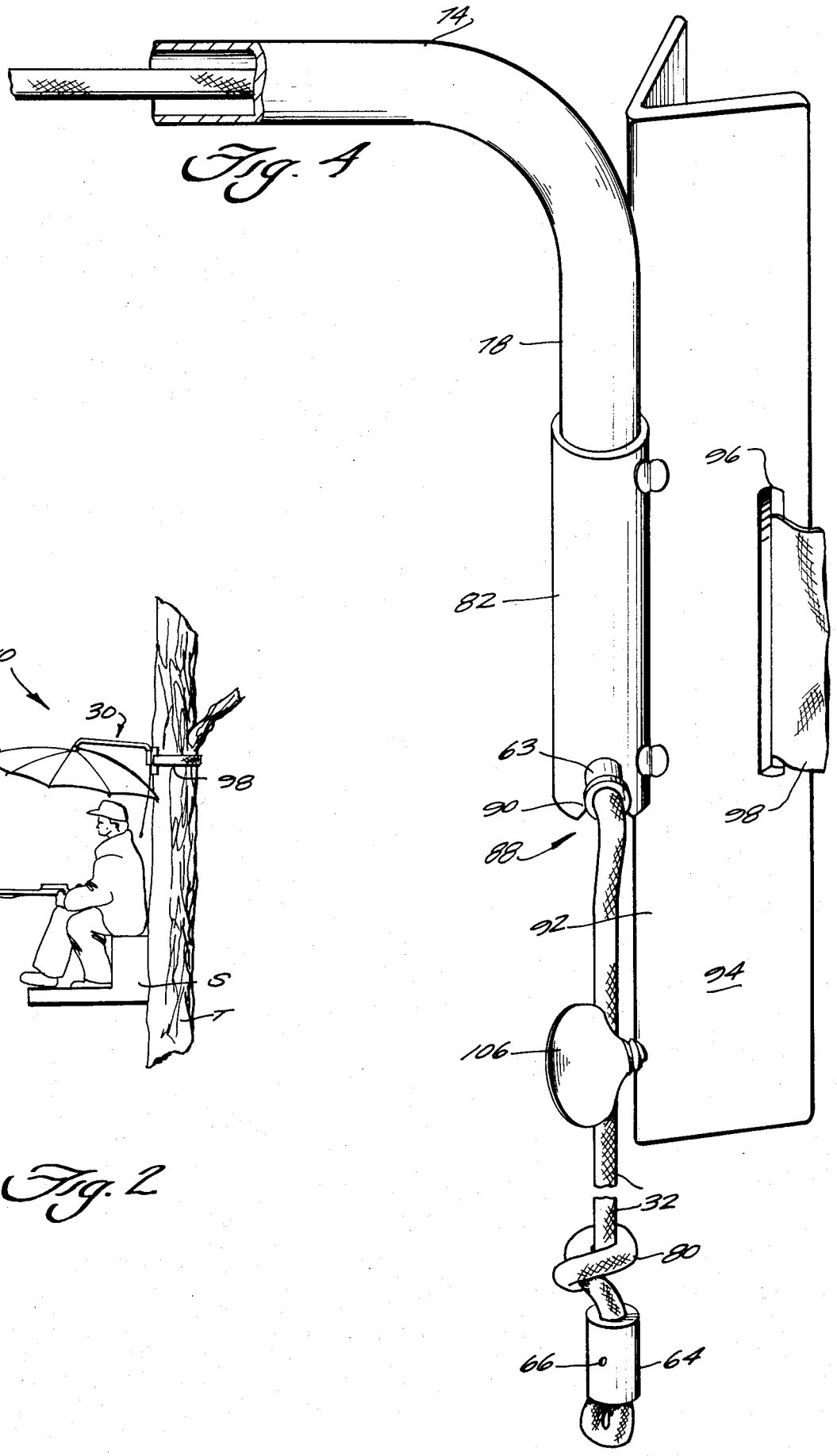
FIG. 4 is a fragmentary longitudinal perspective view of part of the device on the same scale as FIG. 3, but centered on the bracket.

With regard to the embodiment shown in FIGS. 1–4, the device 10, a top-erected umbrella with a cantilevered support, is shown in FIG. 1 separated into two sub-assemblies. The first, shown at the left is the umbrella unit 12 and second, shown at the right is the bracket unit 14.

The umbrella unit 12 includes a flexible, e.g. fabric canopy 16 mounted on a conventional frame 18 of radiating ribs 20 and stretchers 22. At the top center the canopy 16 is coaxially provided with a round opening that is lined and reinforced by a ring-shaped grommet 24. Axially underlying the grommet 24 within the canopy is a frame ring 26 to which each of the ribs 20 is pivotally secured. The stretchers 22 have their outer ends conventionally pivoted to respective ribs midway along the respective ribs. The inner ends of the stretchers are pivoted to an anchor tube 28. So much of the umbrella unit as has been described thus far, i.e. the umbrella canopy and frame sub-unit 29 is subject to being commercially purchased as an off-the-shelf item, although other or more elaborate apparatus could be custom designed or custom made for the device 10.

The umbrella unit further includes an erector rope sub-unit 30, which may be made up separately, and includes a rope 32, e.g. of top quality braided nylon clothesline or tent stay rope, preferably having a limited amount of elasticity in the longitudinal direction. A tubular guide and anchor sleeve 34 is strung onto one end of the rope 32 and the rope is knotted at 36 at that end to keep the sleeve 34 from slipping off. The sleeve 34 includes an upwardly directed end portion 38 of reduced external diameter which defines an upwardly facing annular shoulder 40 where it adjoins the remaining lower part 42 of the sleeve and has a tapering nose 43 at its upper end. In its lower part 42 the sleeve is shown provided on a diameter with a rather small bore transverse opening 44.

Above the sleeve a tubular clamp 46 is strung on the rope 32, the clamp 46 is shown including a lower tubular clamp element 48 that has an internally threaded upper end portion 50 and a smooth-bored lower end portion 52 with a flared internal guide surface 54. The upper tubular clamp element 56 includes an externally threaded lower end portion 58 of reduced diameter. Simply stated, the upper clamp element lower portion 58 may be threaded into the lower clamp element upper portion in order to provide two annular clamp jaws 60, 62 in confronting relation, which are brought closer together by threading one clamp element into the other. The jaw 60 is provided by the upper end of the lower clamp element and the jaw 62 is provided as a shoulder at the upper end of the lower portion 58 of the upper clamp element. Of course, which clamp element threads into which could be reversed and yet provide two confronting jaws in substantially the same way.

At a particular location, i.e. located a predetermined distance along the rope 32 from the knot 36, an enlarged bead, e.g. in the form of a tubular collar 63 is secured e.g. by crimping onto the rope.

At its opposite, inner end the rope 32 is looped and/or knotted and/or provided with an end bead in the form of a collar 64 fastened e.g. by a transverse pin 66 onto the rope 32.

It is necessary to partially disassemble the erector rope sub-unit 30 in order to mount it to the umbrella canopy and frame sub-unit 29. For instance, the knot 36 is temporarily undone, and the anchor sleeve 34 and lower clamp element 48 are slid off. The temporarily unknotted end of the rope 32 is then slipped down through the umbrella canopy center grommet 24 and down through the frame ring 26. Next the lower clamp element 48 and anchor sleeve 34 are threaded back onto the rope 32 and the lower portion 42 of the anchor sleeve 34 is slid into the anchor tube 28 from above and pinned there by a transverse pin 68 such as a rivet passing through the transverse opening 44 and an aligned transverse opening 70 through the anchor tube 28. Comparable or equivalent other securement means could be provided instead. Next, the clamp 46 is threadably made up with the two rings 24, 26 squeezed together and held between its jaws. Thus, the clamp 26, when made up, becomes a tubular hub coaxially fixed to the canopy and frame sub-unit in penetrating relation at the apex of the canopy. Further, the upper portion 72 is thereby fixed as an upstanding mounting post surmounting the apex of the canopy, on top of and outside the canopy.

The umbrella unit 12 is completed by a swing tube 74. This element is shown being an arch-shaped rigid tube with a downwardly opening outer end 76 and a downwardly opening inner end 78. The length L of the swing tube directly between the two ends 76 and 78 generally will be at least slightly greater than a minor radius of the canopy 16, i.e. a radius taken midway between any two ribs 20.

The I.D. of the outer end 76 of the swing tube is slightly greater than the O.D. of the upstanding peg 72.

The swing tube length L can be somewhat longer than a greater diameter of the canopy if it is desired that the canopy be rotatable relative to the swing tube.

Preferably, the swing tube is threaded onto the collared end 64 of the rope 32 and a loose knot 80 may then be tied next to the collar 64 in order to keep the swing tube 74 on the rope.

The umbrella unit 12 as described thus far is the same for all three disclosed embodiments. What is different for the three species is the bracket unit.

First the bracket unit 14 of the first embodiment will be described, with reference to FIGS. 1–4.

The bracket 14 comprises an upright bracket tube 82 having a throughbore 84 that is of slightly larger I.D. than the O.D. of the inner end 78 of the swing tube. The rim of the lower end 86 of the bracket tube 82 is provided with at least one downwardly opening notch 88, which preferably has convergent lead-in surfaces 90.

To this point, the bracket unit is the same for all three embodiments shown in the drawings.

Continuing with reference to the first embodiment, the bracket tube 82 is shown welded to the outside corner of an angle channel member 92, each of the flanges 94 of which is provided with a vertically elongated slot 96. A strap or belt 98, having tightenable securement means on its two opposite ends, is threaded through the slots 96 so that the bracket tube 82 lies intermediate the ends of the belt 98. In the instance shown, the belt 98 is of conventional seat belt webbing 100 and is provided with a conventional seat belt buckle 102.

For use, the seat belt is run around a tree or similar standard, and its end 104 is threaded through its buckle 102 and pulled tight until the belt tightly hugs the tree girthwise. By preference, the angle channel member 92 further mounts a thumb screw 106 threaded into the corner from the outside. The thumb screw 106 may be threadably backed outwards, so that its shank free end is retracted between the flanges. Then, once the belt is mounted on a tree trunk as just outlined, the thumb screw 106 may be threaded in so that the shank free end projects tightly against the tree. This tightens the belt further and prevents rotation or slippage of the tightened belt so that the bracket tube 82 is given a stable and fixed location on the tree trunk.

To assemble the umbrella unit 12 to the bracket unit 14 once the bracket unit 14 is already mounted on the tree trunk as aforesaid, the collared end 64 of the rope 32 is threaded down through the bracket tube 82, the outer end 76 of the swing tube 74 is slipped onto the peg 72 and the inner end 78 of the swing tube 74 is slipped into the bracket tube 82.

At this time, the umbrella canopy is in a collapsed condition. In order to erect it and lock it in an erected condition, the collared end 64 of the rope 32 is pulled down and tensioned, stretching it elastically somewhat until the umbrella canopy is fully erected and the bead 63 appears below the lower end 86 of the bracket tube 82. Then the rope end 64 is pulled sideways to pull the rope just above the bead 63 into the notch 88. Then, if one lets loose of the rope the bead 63 is trapped against the outside of the bracket tube 82 beside the notch 88. The fact that the rope must elastically stretch to permit this latching to occur and be maintained keeps the canopy properly taut in its erected condition. Thus the erector rope sub-unit is multifunctional.

It should be noticed that as the rope end 64 is pulled on to erect the umbrella canopy, the anchor sleeve 34 and the anchor tube 28 with it are pulled upwards, so that the pin end 38 of the anchor sleeve enters and telescopes into the lower end of the bore of the lower clamp element 48. Further penetration is stopped when the shoulder 40 abuts the lower end of the lower clamp element 48.

While the canopy is in an erected condition, and the bead 63 is locking the rope against relaxation and retraction, the umbrella unit 12 is thereby locked to the bracket unit 14. However, the umbrella may be moved laterally, because the swing tube may be pivotally moved to a limited degree in the bracket tube 82. (The limitation is provided when the outer periphery of the canopy engages the tree trunk at the ends of its short arc of possible lateral movement.)

Figure 2:
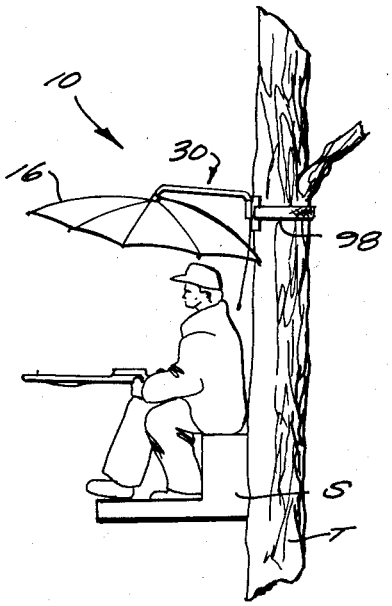
FIG. 2 is a smaller scale side elevation view of the device fully assembled erected, and in typical use by a hunter.

Possible uses for the device 10 are many. In FIG. 2 a typical use is shown, where the device 10 is shown providing a shelter for an up-tree hunter who is seated on a tree stand seat S mounted on the same tree trunk T beneath the device 10 of the invention.

Collapsing and taking down the device 10 are accomplished by reversing the above procedures. Often the device, when not in use, will merely be disassembled into the two units shown in FIG. 1, or these two units may be left loosely assembled via the rope 32 which is left stringing the units together.

Now the differences shown in FIGS. 5–9 will be set forth briefly. In both the second and third embodiments, the object is to mount the bracket on something different from a tree trunk, e.g. on a post or mast.

The second embodiment is shown in FIGS. 5 and 6. In this version, the bracket tube 82 is, instead, secured to a second bracket tube 108 so that the two are disposed side by side. The second bracket tube 108 is provided intermediate its ends with a thumb screw 110 which may be threaded in from the outside to constrict its bore 112.

On the structure on which the device 10′ of the second embodiment is to be mounted, a bracket plate 114 is secured; in the instance depicted the plate 114 is mounted by screws on the back of a fisher's chair. The bracket plate has a lower, third bracket tube 116 secured thereto so as to have its bore 118 disposed in an upright condition. The bracket tube 116 is provided intermediate its ends with a thumbscrew 120 which may be threaded in from the outside to constrict its bore 118.

In this second embodiment, the umbrella canopy may be raised and locked in a raised condition in the same manner as is explained above. The second bracket tube is slipped onto the upper end of a pole, mast or the like 122 and secured at the desired height thereon by running in the thumb screw 110. The lower end of the mast 122 is slipped into the bore 118 of the third bracket tube 116 and the thumb screw 120 is run in to lock the mast at a desired height relative to the fisher's chair. Thus, in this embodiment independent height adjustments may be provided at opposite ends of the mast by adjusting the height of the fixation of the second and third bracket tubes to the mast.

The third embodiment is shown in FIGS. 7–9. In this version, the bracket tube 82 is fixed at or near the upper end of a mast section 124. The bracket tube 82 is provided with a thumb screw 126 which may be threaded radially in from the outside for constricting its throughbore 84.

The lower end of the bore of the mast section 124 telescopically receives a lower mast section 130. The two mast sections may be telescoped to a greater or lesser extent as desired by the user, and locked in place by turning in the thumb screw 132 provided in the telescopically outer one of the mast sections near its overlapping end for engagement with the other of said mast sections. The lower mast section 130 is shown having a radially-directed stop flange 134 secured thereto to limit, by contact with the ground, the extent to which the pointed lower end spike 136 of the lower mast section 130 may be pushed into the ground.

A preferred use of the third embodiment is shown in FIG. 7. Here, a dove hunter D has set up his chair and has erected and mounted his umbrella 10″ in a way to give himself more shade. In particular, he has arranged the mast to be of desired height and has turned the thumb screw 132 to preserve that relationship; he has secured the swing tube 74 inner end 78 in the bore 84 of the bracket tube 82 by running in the thumb screw 126 to set a desired angle; he has aligned the mast with the direct rays of the sun S, as indicated by the arrow R, and plunged the spike 136 into the ground until the hilt-like flange 134 has engaged the ground. Then he has taken up a hunting position from his shaded chair as illustrated.

A convenient way for storing the device 10″ is shown in FIGS. 8 and 9. There, the mast has been telescopically fully condensed and locked in that condition using the thumb screw 132. The canopy 16 has been collapsed by unlatching the bead 63 by pulling on the rope, centering it, and letting loose so that the bead 63 is freed from being trapped against the outside of the notch 88 and the rope end is free to travel outwards in the swing tube and to elastically relax. The swing tube inner end has been freed from the bracket tube 82 and the swing tube outer end has been slipped off of the upstanding peg 72 on top of the canopy apex. This peg, and the now limp rope 32 passing out of its bore are pushed up into the lower end 86 of the throughbore of the bracket tube 82. An elastic endless band 138, e.g. of rubber or rubberized cloth may be stretched over the resulting collapsed canopy and mast assembly and allowed to elastically constrict to lash the assembly together near the outer, lower rim of the collapsed canopy as shown. Instead of such a scrap 138, a tie or other securement may be provided on the mast for encircling the collapsed canopy or otherwise holding the collapsed canopy against the mast.

It should now be apparent that the toperected umbrella with cantilevered support as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A top-erected umbrella with cantilevered support, comprising:

an umbrella canopy of flexible sheet material mounted to an umbrella frame having a plurality of ribs radiating from pivotal connection to a frame ring; the umbrella canopy having an apical opening in axial superimposed alignment with the frame ring; an anchor tube under said canopy in axial alignment with said frame ring; the umbrella frame further having a plurality of radiating stretchers, each having one end pivotally mounted to the anchor tube and another end pivotally mounted to a respective rib, so that moving the anchor tube axially towards the frame ring will cause the canopy to be raised to an erected condition from a collapsed condition;

an erector rope sub-unit comprising a rope having a first enlargement provided on a first, outer end thereof, anchor sleeve means threaded on said rope and disposed adjacent said first enlargement, said anchor sleeve means having an upper portion of reduced diameter, providing a guide finger having a shoulder at the base thereof; a tubular clamp strung on said rope above said anchor sleeve and having a lower tubular portion and an upper tubular portion, each portion having a clamping jaw, the two clamping jaws being in axially confronting relation; means for securing the two clamp portions together so that the two clamping jaws are in clamping relation; means providing a second enlargement on the second inner end of said rope, said lower tubular portion of said tubular clamp having downwardly opening throughbore means arranged to slidingly telescopingly receive said guide finger of said anchor sleeve; and an enlarged bead fixed on said rope at a predetermined distance therealong which is further toward said second end than is said tubular clamp;

a bracket tube having an open longitudinal bore and having a notch in the lower end thereof; and means for securely mounting said bracket tube in a generally upright, elevated condition;

a swing tube having a substantial lateral extent and two opposite, generally downwardly directed ends comprising an inner end an an outer end;

said rope being threaded through said umbrella frame and swing tube, so that said first end lies adjacent said anchor tube of said frame and said second end lies accessable below the inner end of the swing tub; means securing the anchor tube to the anchor sleeve means; the clamp being assembled through said canopy apical opening and said frame ring so that said canopy and frame are clamped between said clamp jaws and so that an upstanding peg portion of said clamp rises from the top of said canopy;

for erecting and mounting the umbrella, the outer end of the swing tube being telescoped with said upstanding peg, the inner end of the swing tube being telescoped with the bracket tube so that the inner end of the rope lies exposed below the bracket tube, and the inner end of the rope being pulled down until said bead has emerged downwards through the bracket tube, whereupon the inner end of the rope has been pulled laterally to pull the rope just above the bead into said notch in the lower end of the guide tube.

2. The top-erected umbrella with cantilevered support of claim 1, wherein:

the rope is made of somewhat elastically resilient material and is sufficiently short that the rope must be elastically stretched in order to pull said bead to the outside of said notch for locking the umbrella canopy in a raised condition.

3. The top-erected umbrella with cantilevered support of claim 1, wherein:

said bracket tube further includes means thereon selectively engageable with said swing tube for fixing said swing tube against rotation thereabout.

4. The top-erected umbrella with cantilevered support of claim 1, wherein:

said means for securely mounting said bracket tube in a generally upright elevated condition comprises:

a bracket having said bracket tube fixed thereto; and means for mounting said bracket at an elevated location.

5. The top-erected umbrella with cantilevered support of claim 4, wherein:

said means for mounting said bracket comprises a seat belt-like strap mounted to said bracket and having securement means permitting the strap to be secured to itself in an adjusted-to-tightness condition while encircling an extraneous support object such as a tree trunk.

6. The top-erected umbrella with cantilevered support of claim 5, wherein:

the bracket is an angle channel with two flanges joined at an outside corner, said bracket tube being secured to said bracket along said outside corner; each flange having a slot therethrough; said strap being mounted to said bracket by being threaded through both of said slots.

7. The top-erected umbrella with cantilevered support of claim 6, wherein:

said bracket further includes thumb screw means threaded from the outside into said angle channel at said outside corner; said thumb screw means having a shank which can be projected beyond and retracted between said flanges by turning said thumb screw, for further securing the bracket on said extraneous support.

8. The top-erected umbrella with cantilevered support of claim 4, wherein:

said bead comprises an annular band crimped onto the rope.

9. The top-erected umbrella with cantilevered support of claim 4, wherein:

said means for mounting said bracket comprises:

a mast, and means for securing the bracket to the mast.

10. The top-erected umbrella with cantilevered support of claim 9, wherein:

said means for securing the bracket to the mast comprises a second bracket tube secured to the first-mentioned bracket tube; the second bracket tube being slidably mounted on the mast and further including means engageable with the mast for securing said bracket to said mast at a selected height.

11. The top-erected umbrella with cantilevered support of claim 10, further including:

a third bracket tube slidably mounted on said mast below said second bracket tube and further including means engageable with the mast for securing said third bracket tube to said mast at a selected height; and means provided on said third bracket tube for securing said third bracket tube in a generally upright condition to an extraneous support object such as a fisher's chair back.

12. The top-erected umbrella with cantilevered support of claim 9, wherein:

the mast comprises a plurality of telescoping mast sections and means for securing the mast sections together at an adjustable selected degree of telescoping.

13. The top-erected umbrella with cantilevered support of claim 9, wherein:

the mast further includes a pointed spiked lower end so that the mast may be jabbed into the ground to support the umbrella.

14. The top-erected umbrella with cantilevered support of claim 9, wherein:

said bracket tube is sized to telescopically receive said umbrella frame upstanding spike and said rope in the lower end thereof when the umbrella canopy is in a collapsed condition, so that the collapsed canopy may be banded for storage of the top-erected umbrella with cantilevered support as a unitary structure.

* * * * *